US007699724B1

(12) United States Patent
Derisse

(10) Patent No.: US 7,699,724 B1
(45) Date of Patent: Apr. 20, 2010

(54) BALL THROWING MUSCLE TRAINING APPARATUS

(76) Inventor: Roudy Derisse, 1230 Monroe Blvd., Lantana, FL (US) 33462

( * ) Notice: Subject to any disclaimer, the term of this patent is extended or adjusted under 35 U.S.C. 154(b) by 462 days.

(21) Appl. No.: 11/644,134

(22) Filed: Dec. 22, 2006

(51) Int. Cl.
*A63B 69/00* (2006.01)
*A63B 21/00* (2006.01)
*A63B 21/05* (2006.01)
*A63B 21/04* (2006.01)

(52) U.S. Cl. ..... 473/451; 473/422; 482/92; 482/129; 482/128

(58) Field of Classification Search ..... 473/422, 473/451, 453, 445, 458, 457, 229; 482/92, 482/99, 109, 120, 121, 122, 118, 129
See application file for complete search history.

(56) References Cited

U.S. PATENT DOCUMENTS 3,618,942 A * 11/1971 Bates et al. ..... 482/129
4,135,714 A * 1/1979 Hughes ..... 482/127
4,328,964 A * 5/1982 Walls ..... 482/129
4,592,545 A 6/1986 Sagedahl et al.
4,717,149 A * 1/1988 Juhl ..... 473/429
4,846,471 A * 7/1989 Haysom ..... 473/451
5,178,598 A 1/1993 Finch
5,269,512 A 12/1993 Crowson et al.
5,391,132 A 2/1995 Greenwald
5,423,730 A * 6/1995 Hirsch ..... 482/92
5,688,212 A 11/1997 Walker
5,709,637 A * 1/1998 Gow et al. ..... 482/129
6,007,500 A * 12/1999 Quintinskie, Jr. ..... 601/5
6,149,559 A * 11/2000 Mackey ..... 482/124
6,413,196 B1 7/2002 Crowson
6,537,184 B2 * 3/2003 Kim ..... 482/122
6,572,497 B1 * 6/2003 Halsworth ..... 473/453
6,884,187 B2 * 4/2005 Cataldi, Jr. et al. ..... 473/451
7,048,638 B2 * 5/2006 Novotny ..... 473/219

* cited by examiner

*Primary Examiner*—Mitra Aryanpour
(74) *Attorney, Agent, or Firm*—Frank L. Kubler

(57) ABSTRACT

A muscle memory training apparatus for training a ball player in proper elbow elevation at the beginning of a throw includes a frame; an elbow support cup assembly mounted to and projecting forwardly from the frame; a spring-loaded reel mounted to the frame a distance above the support cup assembly and having a retracting line secured to a ball mounted to the frame; and a fastening mechanism connected to the frame for fastening the apparatus to an anchoring object at a suitable elevation. A method of using the muscle memory training apparatus includes the steps of: securing the apparatus to a selected anchoring structure such that the elbow support cup is substantially at the user shoulder level; placing the user elbow in the elbow support cup; grasping the ball; and throwing the ball forwardly from the apparatus, so that the ball is subsequently retracted by the spring-loaded reel.

14 Claims, 8 Drawing Sheets

BALL THROWING MUSCLE TRAINING APPARATUS

BACKGROUND OF THE INVENTION

1. Field of the Invention

The present invention relates generally to the field of muscle training devices. More specifically the present invention relates to a muscle memory training apparatus for training a ball player in proper elbow elevation at the beginning of a throw, namely at shoulder level. The apparatus includes a frame, an elbow support cup assembly mounted to and projecting forwardly from the frame and a spring-loaded reel mounted to the frame a distance above the support cup assembly corresponding to forearm length, the spring-loaded reel having a retracting line secured to a ball mounted to the frame. A fastening mechanism is provided on the frame for fastening the apparatus to a pole or other anchoring structure at a suitable elevation.

The elbow support cup assembly preferably includes a support cup arm having an arm connected end fastened to the frame and an arm cup end to which an upwardly opening cup is fastened. The cup preferably has an open forward end to permit a user arm to pivot or the elbow to slide forwardly out of the cup during throwing motion. The frame for the first embodiment preferably is an open box structure having a two opposing and spaced apart frame sides each bordered by a frame side perimeter portion, the frame side perimeter portions being interconnected by frame side connecting segments. Within each frame side perimeter portion a side sheet, preferably of mesh, grid or solid sheet material is provided, and preferably perimeter sheets of solid, mesh or grid sheet material also extend between frame side perimeter portions parallel to the side connecting segments. The arm connected end preferably is fastened to a lower segment of one of the frame side perimeter portions, or to a perimeter sheet extending between the lower segments of the frame side perimeter portions. The spring-loaded reel preferably is a self-contained unit within a reel housing secured to upper and forward segments of the frame side perimeter portions, or to the side sheets within the frame side perimeter portions. The frame, side sheets and perimeter sheets preferably are formed of metal such as steel, but may be formed of a suitable durable plastic as well. The fastening mechanism preferably includes at least one flexible tying member for wrapping through the frame and around a selected anchoring structure.

For the second embodiment, the apparatus includes a height adjustment structure which permits readjustment of ball to correspond to the height of any individual user. For this embodiment, the apparatus includes an upright member for mounting to a pole or other anchoring object at a suitable elevation with tying members of the fastening mechanism, a spring-loaded reel housing containing the spring-loaded reel being fastened to a slide member of height adjustment mechanism in turn fastened to the outward face of the upright member, and a support cup arm having an arm connected end fastened to and protruding outwardly from the upright member below the reel housing. The reel housing has a housing port through which the retracting line passes.

To use the apparatus, the user places his or her elbow in the elbow support cup, and then grasps and throws the ball outwardly from the apparatus. As the user throws, his or her elbow normally will leave the elbow support cup, but this is acceptable because the exercise is to train the muscle memory for elbow elevation at the start of the throw. The spring-loaded reel causes the line secured to the ball to retract after the ball travels a few feet, so that the exercise can be repeated.

2. Description of the Prior Art

There have long been practice devices for permitting a user to repeatedly throw a ball or swing a bat. A problem with prior thrown devices has been that they have not provided a positioning mechanism for holding the user elbow at a proper elevation for beginning a throw, so that the throwing muscles are mis-trained.

Prior pitching and throwing exercise devices include Crowson, U.S. Pat. No. 6,413,196, issued on Jul. 2, 2002. Crowson includes a mechanism housing mounted to an upright post extending upwardly from a platform, the mechanism housing containing a pulley and an eccentric cam and a spring-loaded cam tensioning device. A cable pulley connects the pulley to a cam wheel and protrudes from the housing for connection to an object to be gripped such as a bat which is pulled for exercise.

Crowson provided an earlier pitching and batting conditioning device disclosed in U.S. Pat. No. 5,269,512, issued on Dec. 14, 1993. This device is attached to a support surface such as a wall and includes one or more rotatably mounted drums within the housing having different diameters and cables wrapped around each drum for requiring different levels of force to pull against the biasing of an axially mounted spring. A ball or bat is attached to the free end of the selected cable for gripping and pulling to train muscles used in throwing and batting.

Greenwald, U.S. Pat. No. 5,391,132, issued on Feb. 21, 1995 teaches a free standing rotator cuff development device. One embodiment includes a telescoping post having a post upper segment rotatably fitted into a post lower segment which extends upwardly from a base structure, and includes an upwardly or laterally opening elbow cup into which a user rests an elbow. The user rotates the elbow to exercise the muscles at the rotator cuff and may grip a hand weight while doing so. A rod with a mounted hand grip optionally protrudes from the elbow cup structure to rotate together with the elbow cup.

Finch, U.S. Pat. No. 5,178,598, issued on Jan. 12, 1993, reveals an exerciser for softball pitches. Finch includes a rotatable arm rotatably connected to a bearing structure protruding laterally from a support pole so that the arm rotates within a vertical plane, and a ball on a cord is tied to the rotatable arm free end. The bearing structure provides adjustable levels of rotation resistance through progressive clamping of a rotatable surface against brake pads, so that as a user pulls the ball through a throwing motion, the rotatable arm rotates against brake pad resistance.

Sagedahl, et al., U.S. Pat. No. 4,592,545, issued on Jun. 3, 1986, discloses an isokinetic exercise apparatus and method. Sagedahl, et al. includes a shaft connected to a counter-torque machine and a torque arm mounted to the shaft for rotation against counter-torque machine resistance. A ball on a cord may be connected to the torque arm so that a user can pull the ball through a throwing motion against the resistance of the counter-torque machine.

Walker, U.S. Pat. No. 5,688,212, issued on Nov. 18, 1997 teaches a rota-flex freestanding rotational motion and relative displacement training apparatus. Walker includes a vertical support having upper and lower rotational resistance assemblies with adjustable resistance and adjustable elevation.

It is thus an object of the present invention to provide a muscle memory training apparatus for training a user in throwing a ball which includes elbow supporting means for holding the user elbow at the proper elevation at the beginning of the throw.

It is another object of the present invention to provide such an apparatus which automatically returns the ball after each throw for rapid repeated use during training.

It is still another object of the present invention to provide such an apparatus which is compact and easy to install on any of a wide variety of anchoring structures.

It is yet another object of the present invention to provide such an apparatus including a height adjustment structure permitting readjustment of the height of the ball to correspond to the heights of successive individual users of different heights.

It is finally an object of the present invention to provide such an apparatus which is sturdy, safe and economical to manufacture.

SUMMARY OF THE INVENTION

The present invention accomplishes the above-stated objectives, as well as others, as may be determined by a fair reading and interpretation of the entire specification.

A muscle memory training apparatus is provided for training a ball player in proper elbow elevation at the beginning of a throw, the apparatus including a frame; an elbow support cup assembly mounted to the frame; a spring-loaded reel mounted to the frame a distance from the support cup assembly and having a retracting line and secured to a ball; and a fastening mechanism for fastening the apparatus to an anchoring object at a suitable elevation.

The elbow support cup assembly preferably includes a support cup arm having an arm connected end fastened to the frame and an arm cup end to which an upright cup is fastened. The cup has an open cup forward end to permit movement of a user arm while executing a throwing motion. The frame preferably includes an open box structure having first and second two opposing and spaced apart frame sides each with a frame side perimeter portion, the frame side perimeter portions of the first and second frame sides being interconnected by frame side connecting segments. A side sheet preferably is provided within each frame side perimeter portion. The muscle memory training apparatus preferably additionally includes sheets of mesh preferably extend between frame side perimeter portions substantially parallel to the frame side connecting segments.

The arm connected end preferably is fastened to one of the frame side perimeter portions and protrude forwardly from the frame. The spring-loaded reel preferably is a self-contained unit secured to the frame side perimeter portions. The frame and grid preferably are formed of one of: metal and plastic. The fastening mechanism preferably includes at least one flexible tying member for wrapping through the frame and around a selected anchoring structure.

A muscle memory training apparatus is further provided for training a ball player in proper elbow elevation at the beginning of a throw, the apparatus including a frame; an elbow support cup assembly mounted to the frame; a height adjustment structure secured to said frame; a spring-loaded reel mounted to the frame a distance from the support cup assembly and having a retracting line secured to a ball; so that the height adjustment structure permits readjustment of the height of the ball to correspond to the heights of successive individual users.

A method is also provided of using the above described muscle memory training apparatus, including the steps of: securing the apparatus to a selected anchoring structure such that the elbow support cup is substantially at the user shoulder level; placing the user elbow in the elbow support cup; grasping the ball; and throwing the ball forwardly from the apparatus, so that the ball is subsequently retracted by the spring-loaded reel.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
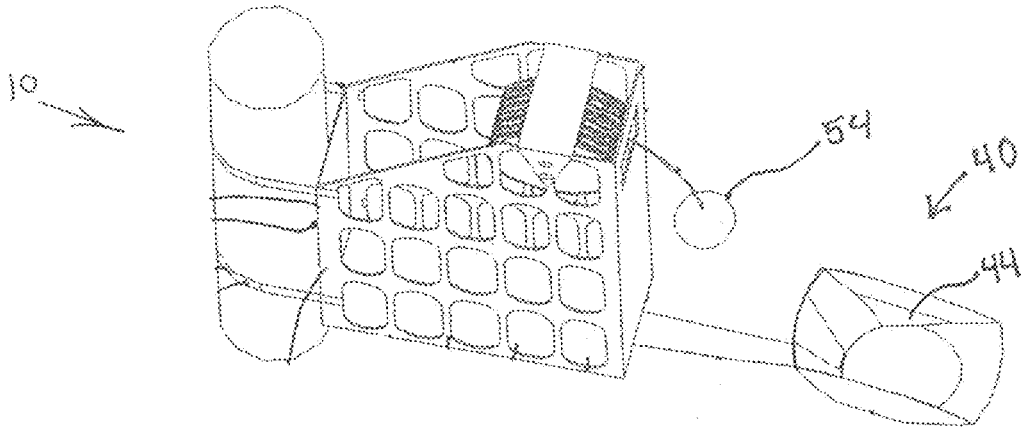
FIG. 1 is an upper perspective view of the first preferred embodiment of the present muscle memory training apparatus, with portions of the side and perimeter sheets removed.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
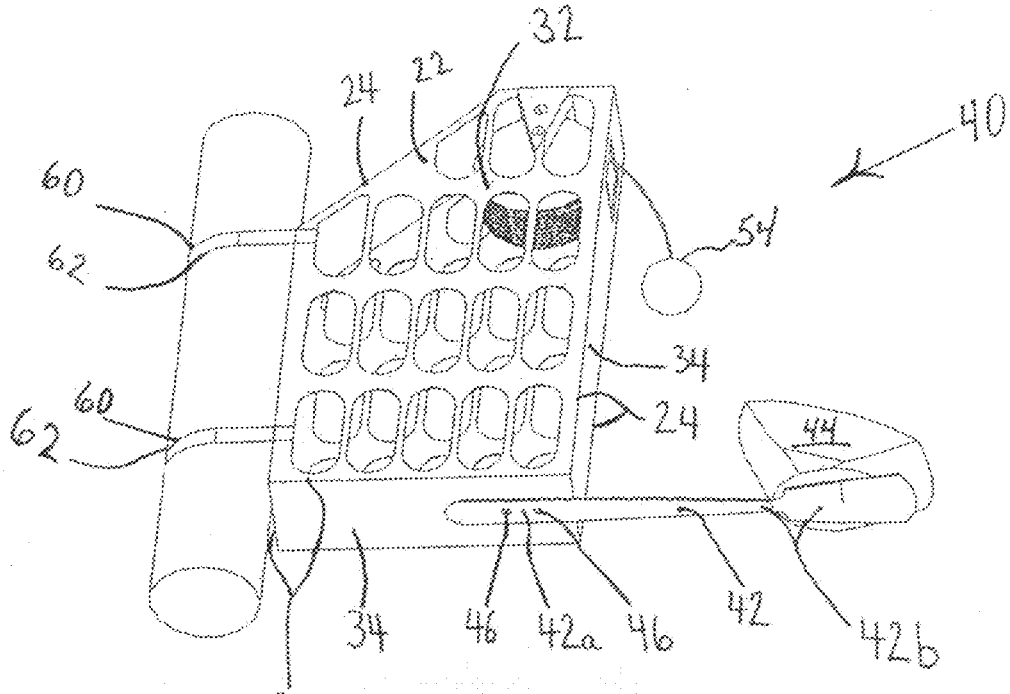
FIG. 2 is lower perspective view as in FIG. 1.
Figure 3:
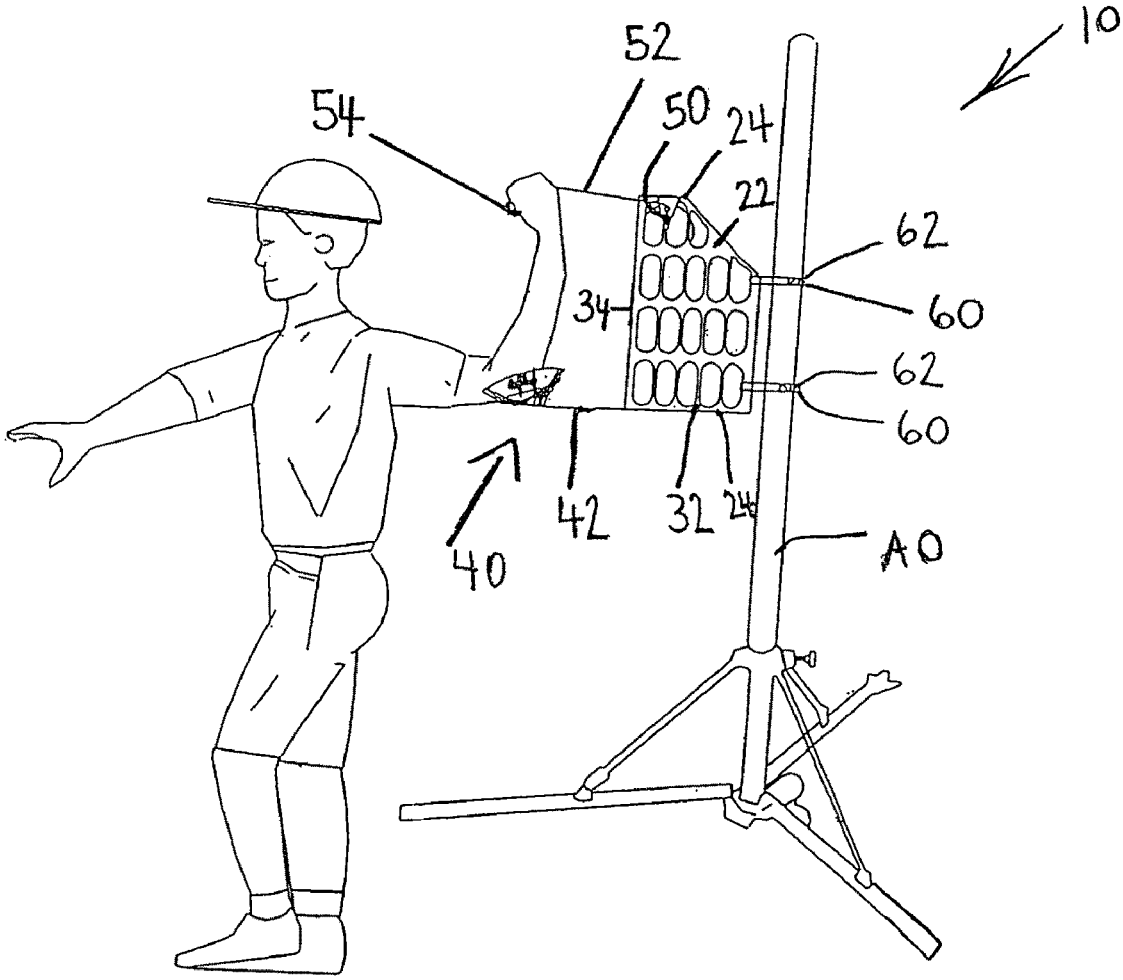
FIG. 3 is perspective side view of the embodiment of FIG. 1 secured to an anchoring structure in the form of a post with tying members, and a user having his elbow seated in the elbow cup and his hand gripping the ball at the proper throwing height and position for the given user.
Figure 4:
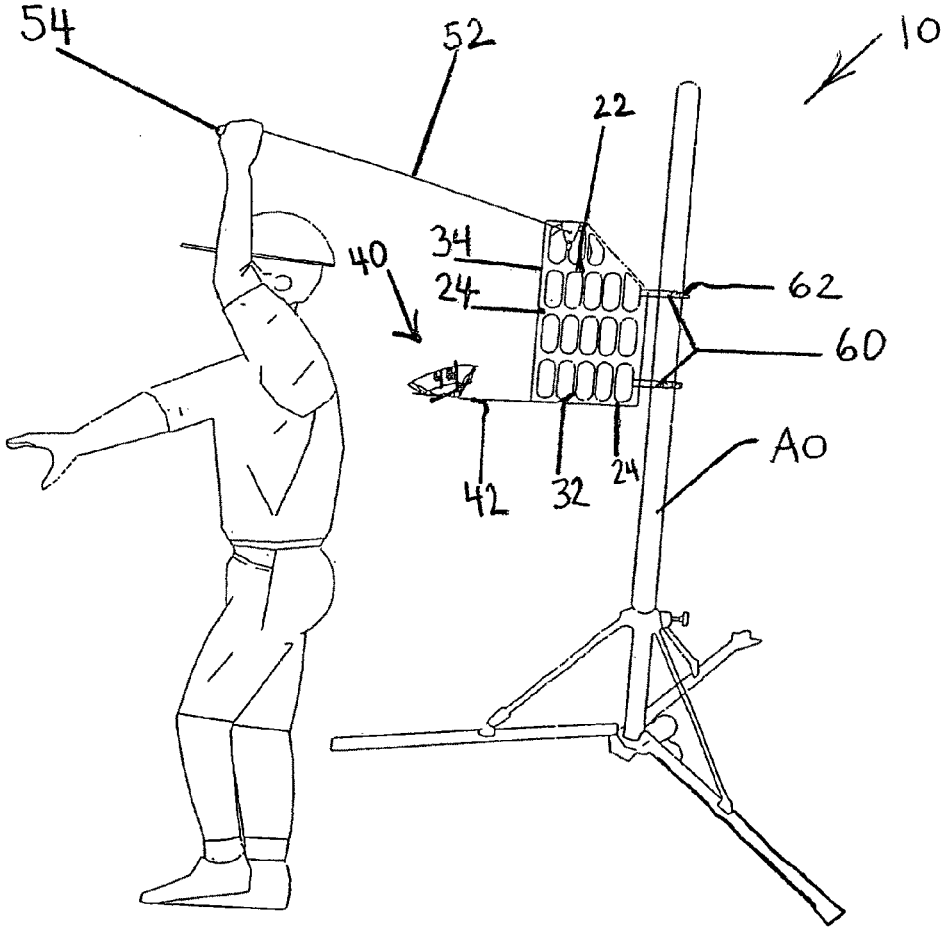
FIG. 4 is a view as in FIG. 3 showing the user midway through an arm throwing movement, with his elbow slid forwardly out of the elbow cup.
Figure 5:
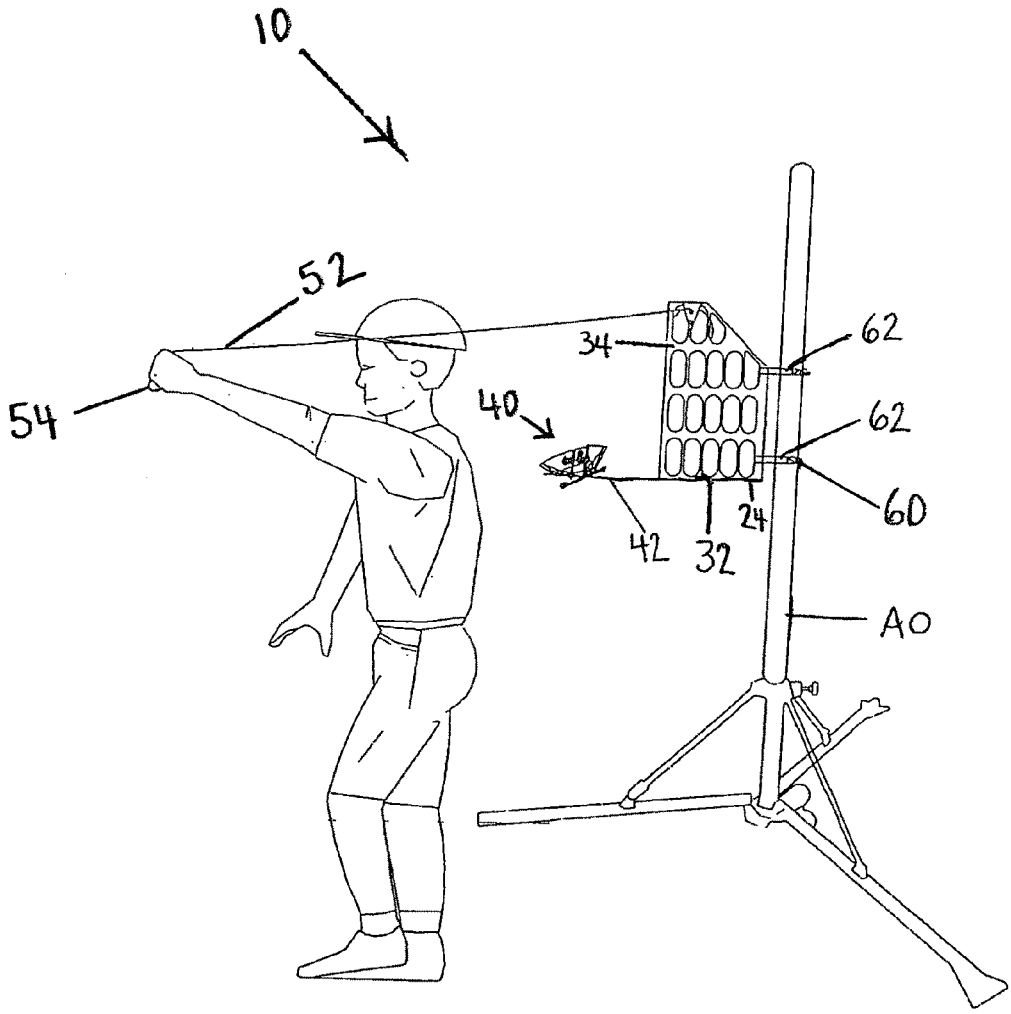
FIG. 5 is a view as in FIGS. 3 and 4 showing the user substantially fully through the arm throwing movement.

Referring to FIGS. 1-5, a muscle memory training apparatus 10 is disclosed for training a ball player in proper elbow elevation at the beginning of a throw, namely at shoulder level. The apparatus 10 includes a frame 20, an elbow support cup assembly 40 mounted to and projecting forwardly from the frame 20 and a spring-loaded reel 50 mounted to the frame 20 a distance above the support cup assembly 40 corresponding substantially to forearm length, the spring-loaded reel having a retracting line 52 secured to a ball 54 mounted to the frame 20. A fastening mechanism 60 is provided on the frame 20 for fastening the apparatus to a pole or other anchoring object AO at a suitable elevation.

The elbow support cup assembly 40 preferably includes a support cup arm 42 having an arm connected end 42*a* fastened to the frame 20 with cup arm fasteners 46 such as screws or rivets and an arm cup end 42*b* to which an upwardly opening cup 44 is fastened. The cup 44 preferably has an open forward end to permit a user arm and the elbow to pivot or slide forwardly out of the cup during throwing motion. The frame 20 preferably is an open box structure having a two opposing and spaced apart frame sides 22 each bordered by a frame side perimeter portion 24, the frame side perimeter portions 24 being interconnected by frame side connecting segments 26. A side sheet 32 of mesh, grid or solid sheet material preferably is mounted within each frame side perimeter portion 24, and perimeter sheets 34 of solid or mesh sheet material preferably also extend between frame side perimeter portions 24 parallel to the side connecting segments 26. The arm connected end 42*a* preferably is fastened to a lower segment of one of the frame side perimeter portions 24, or to the side sheet 34 mesh extending between the lower segments of the frame side perimeter portions 24. The spring-loaded reel 50 preferably is a self-contained unit within a reel housing secured to upper and forward segments of the frame side 22, or to the side sheet 32 within the frame side perimeter portions 24. The frame 20, grid sheets 32 and perimeter sheets 34 preferably are formed of metal such as steel, but may be formed of a suitable durable plastic as well. The fastening mechanism 60 preferably includes at least one flexible tying member for wrapping through the frame 20 and around a selected anchoring structure AS.

Second Preferred Embodiment

Figure 6:
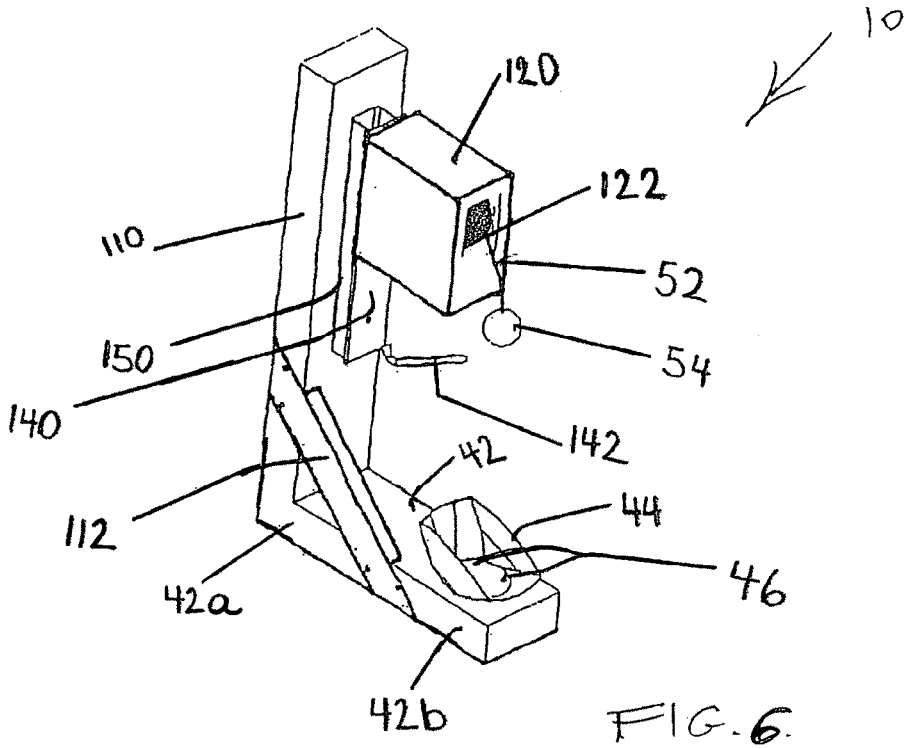
FIG. 6 is an upper perspective view of the second preferred embodiment of the present muscle memory training apparatus.
Figure 7:
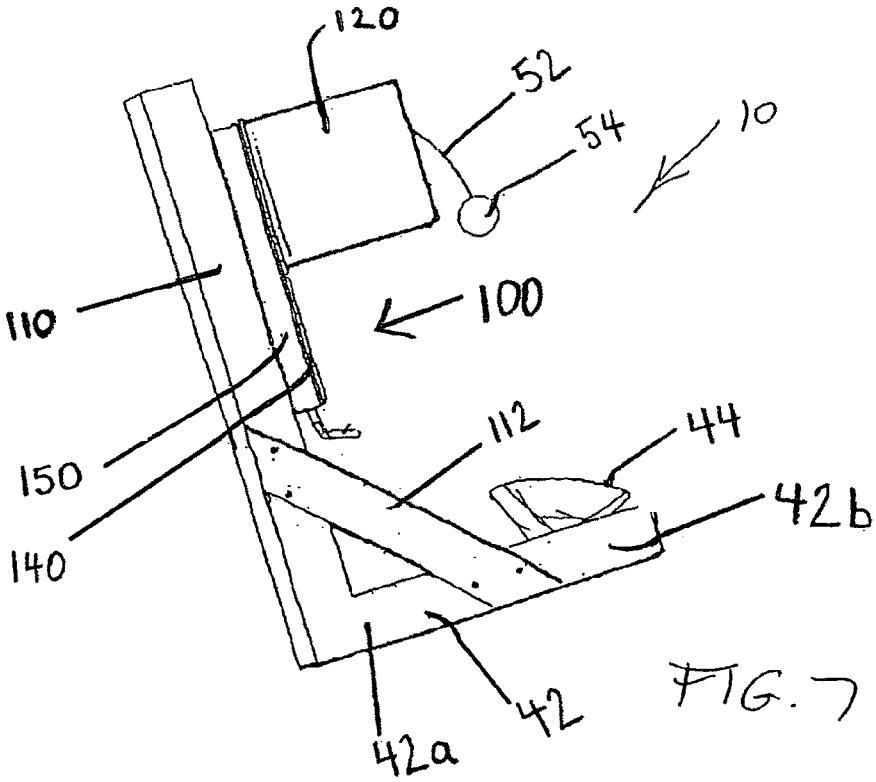
FIG. 7 is a side view of the embodiment of FIG. 6.
Figure 8:
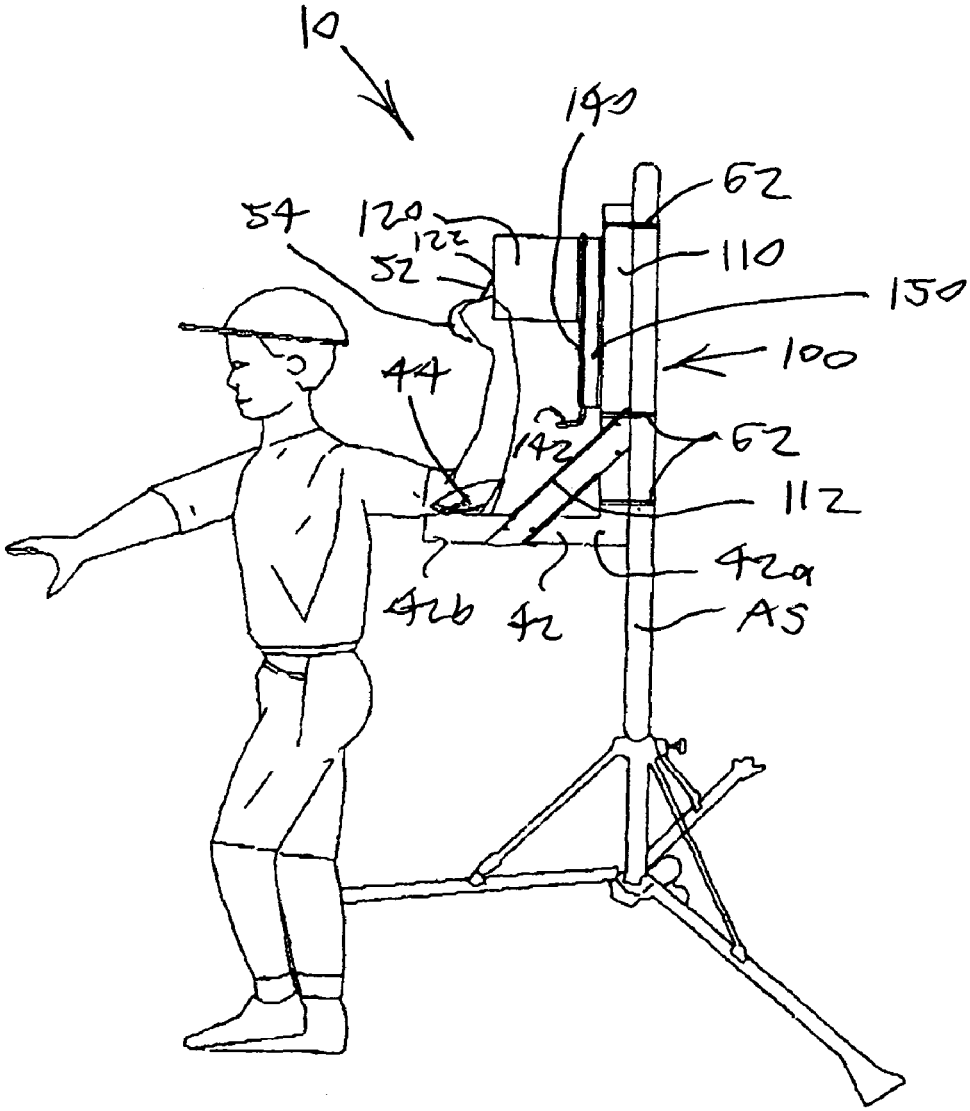
FIG. 8 is perspective side view of the embodiment of FIG. 6 secured to an anchoring structure in the form of a post with tying members, and a user having his elbow seated in the elbow cup and his hand gripping the ball at the proper throwing height and position for the given user.
Figure 9:
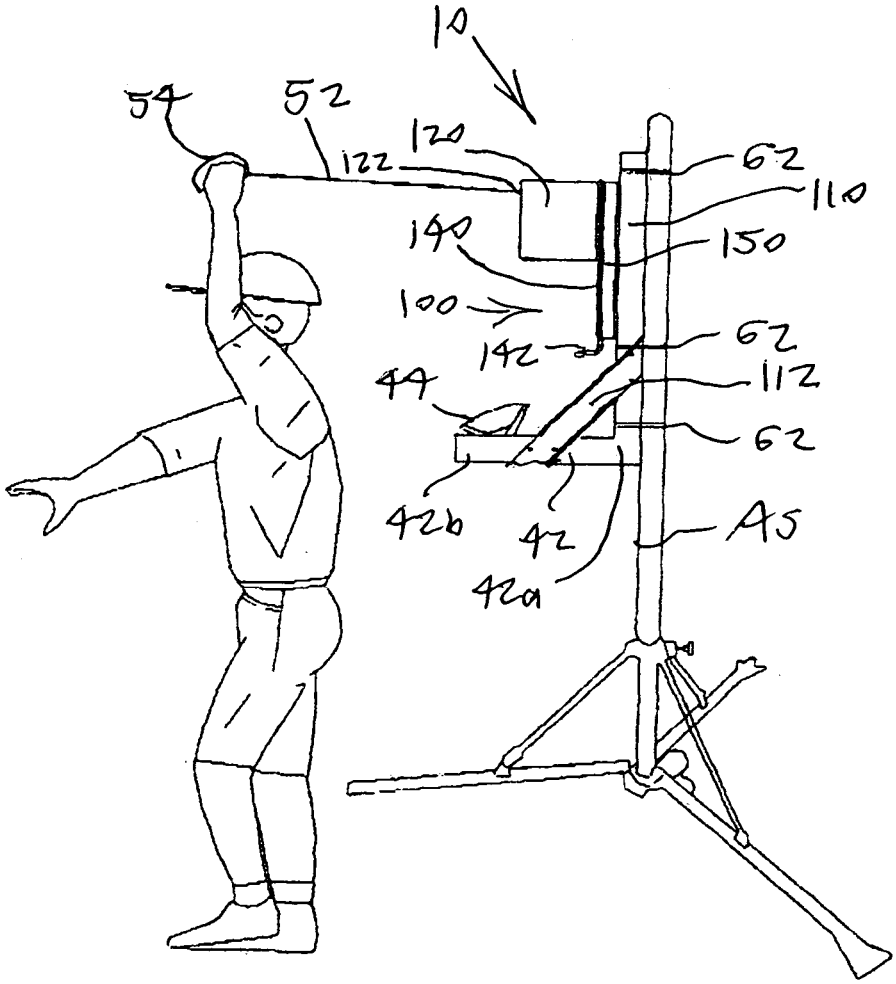
FIG. 9 is a view as in FIG. 8 showing the user midway through an arm throwing movement, with his elbow slid forwardly out of the elbow cup.
Figure 10:
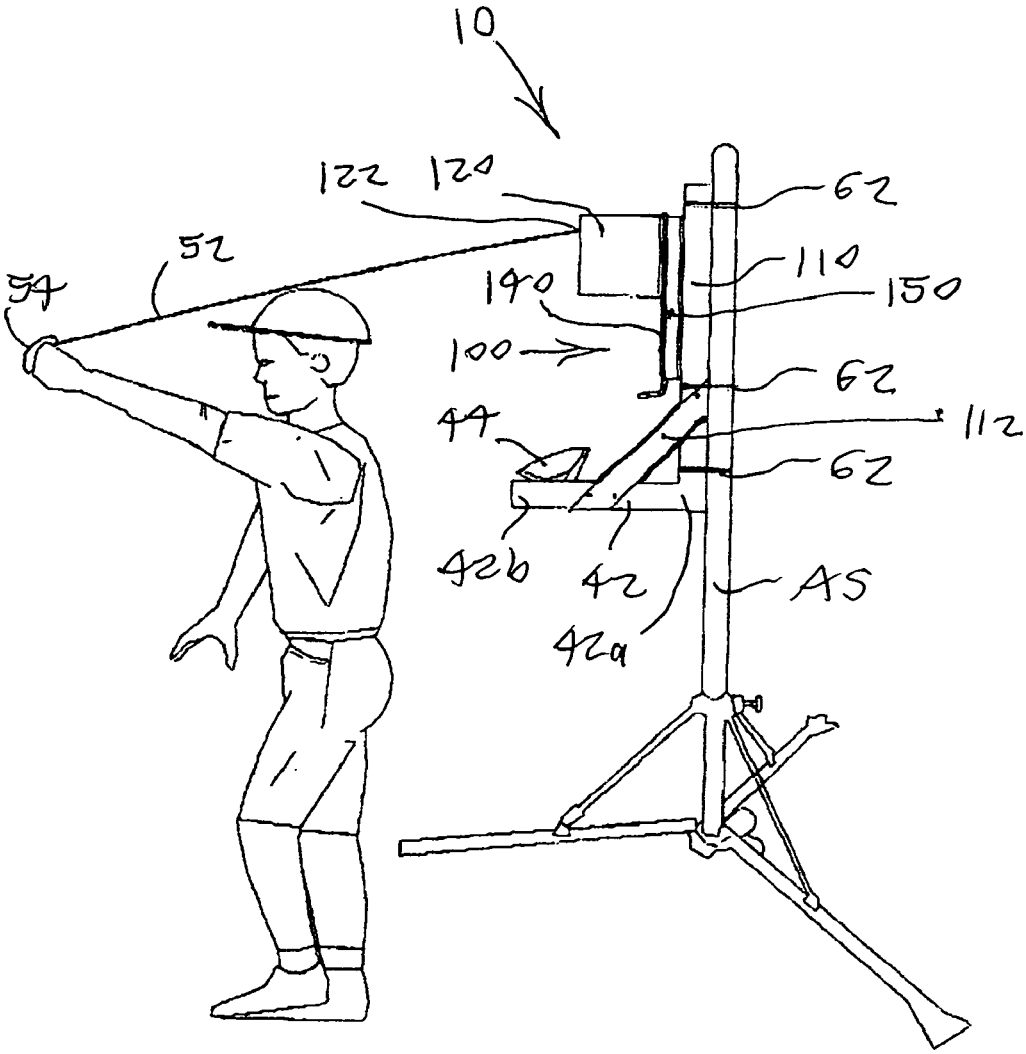
FIG. 10 is a view as in FIGS. 8 and 9 showing the user substantially fully through the arm throwing movement.

Another embodiment of the apparatus 10 includes a height adjustment structure 100 which permits readjustment of ball 54 to correspond to the height of any individual user. See FIGS. 6-10. For this embodiment, apparatus 10 includes an upright member 110 preferably in the form of a vertical wooden plank for mounting to a pole or other anchoring object AO at a suitable elevation with tying members 62 of the fastening mechanism 60, a spring-loaded reel housing 120 containing the spring-loaded reel 50 being fastened to a slide member 140 of height adjustment mechanism 100 in turn fastened to the outward face of the upright member 110, and a support cup arm 42 having an arm connected end 42*a* fastened to and protruding outwardly from the upright member 110 below the reel housing 120 preferably in the form of a horizontal wooden plank, and a diagonal support strut 112 interconnecting and adding structural support to brace support cup arm 42. The support cup arm 42, as in the first embodiment, has an arm cup end 42*b* on which the cup 44 is mounted with cup arm fasteners 46 such as screws or rivets. The reel housing 120 has a housing port 122 through which the retracting line 52 passes.

The adjustment mechanism 100 includes both slide member 140 and a mounting track 150, and a locking mechanism and release arm 142 and preferably is an automobile adjustable seat track. The slide member 140 of the preferred adjustment mechanism 100 is released for vertical movement relative to the mounting track 150 and user by pivoting a release arm 142 in a first direction and then locked at a selected height by pivoting the release arm 142 in a second direction.

Method

In practicing the invention, the following method may be used. To use apparatus 10, the user places his or her elbow in the elbow support cup 44, and then grasps and throws the ball 54 outwardly from the apparatus 10. As the user throws, his or her elbow normally will leave the elbow support cup 44, but this is acceptable because the exercise is to train the muscle memory for elbow elevation at the start of the throw. The spring-loaded reel 50 causes the line 52 secured to the ball 54 to retract after the ball 54 travels a few feet, so that the exercise can be repeated.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A muscle memory training apparatus for training a ball player in proper elbow elevation at the beginning of a throw, the apparatus comprising:

a frame;

an elbow support cup assembly mounted to said frame;

a spring-loaded reel mounted to said frame a distance from said elbow support cup assembly and having a retracting line secured to a ball;

and a fastening mechanism for fastening the apparatus to an anchoring object at a suitable elevation.

2. The muscle memory training apparatus of claim 1, wherein said elbow support cup assembly comprises a support cup arm having an arm connected end fastened to said frame and an arm cup end to which an upright cup is fastened.

3. The muscle memory training apparatus of claim 2, wherein said cup has an open cup forward end to permit movement of a user arm while executing a throwing motion.

4. The muscle memory training apparatus of claim 1, wherein said frame comprises an open box structure having first and second opposing and spaced apart frame sides each with a frame side perimeter portion, said frame side perimeter portions of the first and second frame sides being interconnected by frame side connecting segments.

5. The muscle memory training apparatus of claim 4, additionally comprising a side sheet within each said frame side perimeter portion.

6. The muscle memory training apparatus of claim 5, additionally comprising perimeter sheets extending between frame side perimeter portions substantially parallel to said frame side connecting segments.

7. The muscle memory training apparatus of claim 5, wherein said arm connected end is fastened to one of said frame side perimeter portions and protrudes forwardly from said frame.

8. The muscle memory training apparatus of claim 6, wherein said spring-loaded reel is a self-contained unit secured to said frame side perimeter portions.

9. The muscle memory training apparatus of claim 6, wherein said frame and grid are formed of one of: metal and plastic.

10. The muscle memory training apparatus of claim 1, wherein fastening mechanism comprises at least one flexible tying member for wrapping through the frame and around a selected anchoring structure.

11. A muscle memory training apparatus for training a ball player in proper elbow elevation at the beginning of a throw, the apparatus comprising:

a frame mounted to an anchor structure at a certain height;

an elbow support cup assembly mounted to said frame;

a height adjustment structure secured to said frame;

and spring-loaded reel mounted to said height adjustment structure a distance from said elbow support cup assembly and having a retracting line secured to a ball;

such that said height adjustment structure permits readjustment of the height of said ball to correspond to the heights of successive individual users.

12. The muscle memory training apparatus of claim 11, wherein said height adjustment structure comprises a slide member to which said spring-loaded reel is mounted, and a mounting track secured to said frame, said slide member being slidably secured to said mounting track to slide vertically together with said spring-loaded reel, and a locking mechanism for locking and releasing said slide member relative to said mounting track, and locking mechanism release element.

13. The muscle memory training apparatus of claim 12, wherein said height adjustment structure comprises an automobile adjustable seat track.

14. A method of using a muscle memory training apparatus comprising a frame; an elbow support cup assembly mounted to and projecting forwardly from said frame; a spring-loaded reel mounted to said frame a distance above said elbow support cup assembly and having a retracting line secured to a ball mounted to said frame; and a fastening mechanism connected to said frame for fastening the apparatus to an anchoring object at a suitable elevation, comprising the steps of:

securing the apparatus to a selected anchoring structure such that the elbow support cup is substantially at the user shoulder level;

placing the user elbow in the elbow support cup;

grasping the ball;

and throwing the ball forwardly from the apparatus, such that the ball is subsequently retracted by the spring-loaded reel.

* * * * *